US010451273B2

(12) United States Patent
Rasi

(10) Patent No.: US 10,451,273 B2
(45) Date of Patent: Oct. 22, 2019

(54) GAS BURNER ASSEMBLY

(71) Applicant: Electrolux Appliances Aktiebolag, Stockholm (SE)

(72) Inventor: Fabio Rasi, Forli (IT)

(73) Assignee: Electrolux Appliances Aktiebolag, Stockholm (SE)

( * ) Notice: Subject to any disclaimer, the term of this patent is extended or adjusted under 35 U.S.C. 154(b) by 194 days.

(21) Appl. No.: 15/539,540

(22) PCT Filed: Jan. 19, 2016

(86) PCT No.: PCT/EP2016/050961
§ 371 (c)(1),
(2) Date: Jun. 23, 2017

(87) PCT Pub. No.: WO2016/124388
PCT Pub. Date: Aug. 11, 2016

(65) Prior Publication Data

US 2018/0335208 A1 Nov. 22, 2018

(30) Foreign Application Priority Data

Feb. 5, 2015 (EP) ..... 15153913

(51) Int. Cl.
*F24C 3/00* (2006.01)
*F23D 14/06* (2006.01)
*F24C 3/08* (2006.01)

(52) U.S. Cl.
CPC ..... *F23D 14/06* (2013.01); *F24C 3/085* (2013.01)

(58) Field of Classification Search
CPC ..... F24C 3/085; F24C 3/008; F23D 4/06
(Continued)

(56) References Cited

U.S. PATENT DOCUMENTS 8,753,112 B2 * 6/2014 Armanni ..... F23D 14/065 126/39 E
2004/0195399 A1 * 10/2004 Molla ..... F23D 14/06 239/594

(Continued)

FOREIGN PATENT DOCUMENTS

CN 102439360 A 5/2012
CN 202494111 U 10/2012

(Continued)

OTHER PUBLICATIONS

English Translation of Office action issued in counterpart Chinese Patent Application No. 201680007346.1 dated Sep. 30, 2018, 6 pages.

(Continued)

*Primary Examiner* — Vivek K Shirsat
(74) *Attorney, Agent, or Firm* — Pearne & Gordon LLP

(57) ABSTRACT

The present invention relates to a gas burner assembly (10), in particular for a gas cooking hob, comprising a burner cap (12), a burner crown (14) and a burner body (16). The burner cap (12) is arranged or arrangeable upon the burner crown (14). The burner crown (14) is arranged or arrangeable upon the burner body (16). The gas burner assembly (10) comprises at least one elongated horizontal Venturi pipe (32, 34). An upper part (32) of the Venturi pipe is formed in a lower portion of the burner crown (14). A lower part (34) of the Venturi pipe (32) is formed in the burner body (16). At least one chamber (46, 52) is formed in an upper portion of the burner crown (14). The burner crown (14) includes at least one circumferential wall (22, 24) enclosing the at least one chamber (46, 52) and including a plurality of flame ports (26, 28). The burner crown (14) includes at least one passage opening (38) connecting an outlet of the Venturi pipe (32, 34) to the at least one chamber (46, 52). The Venturi pipe is formed by its upper part (32), its lower part (34) and the (Continued)

Figure 1:
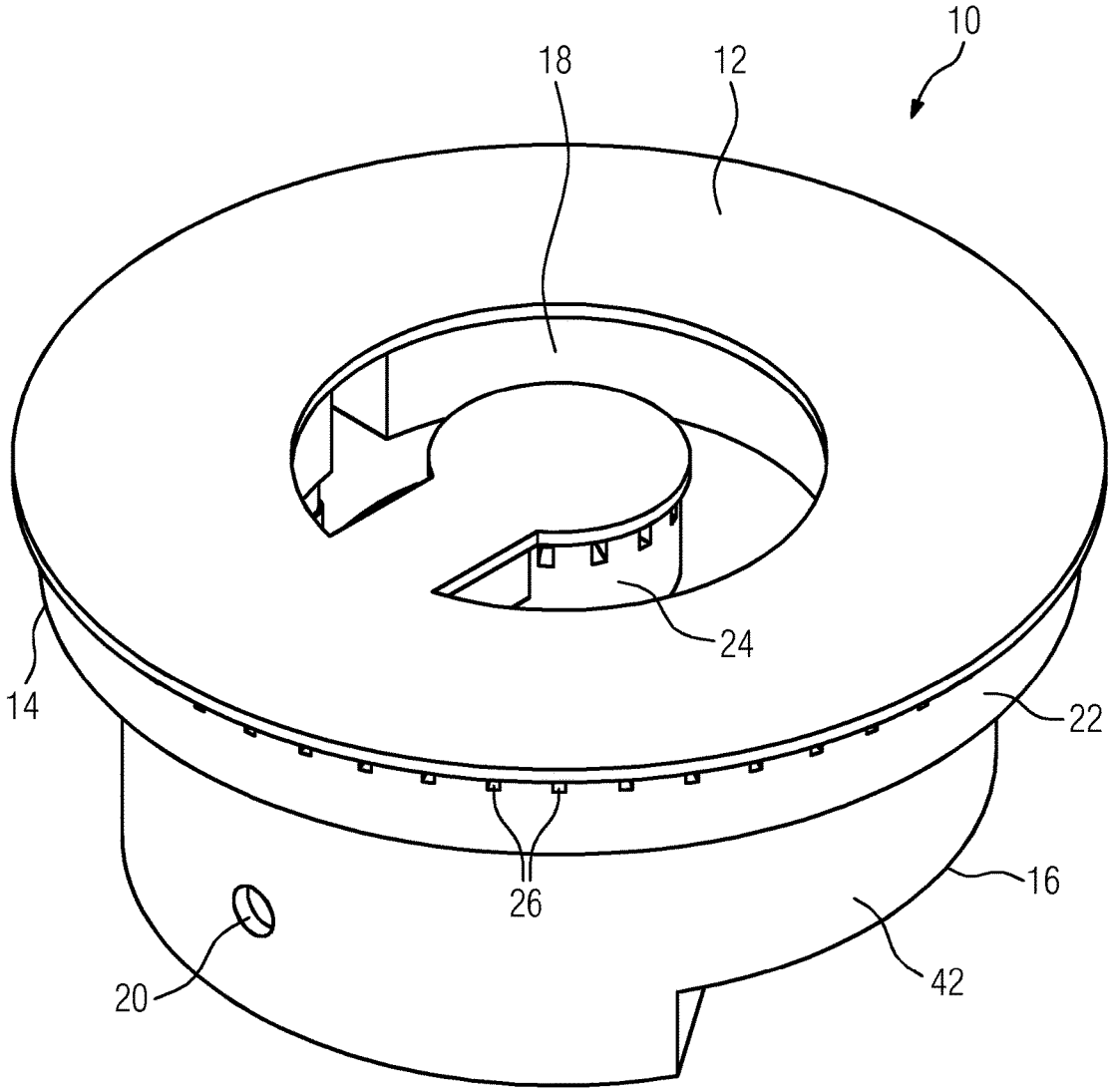

passage opening (38). A horizontal gap (60) is formed between the burner crown (14) and the burner body (16), wherein the horizontal gap (60) is provided as an inlet for primary air (56) and secondary air (58).

15 Claims, 8 Drawing Sheets

(58) Field of Classification Search
USPC ..... 126/39 E, 39 R; 431/354
See application file for complete search history.

(56) References Cited

U.S. PATENT DOCUMENTS

| | | | | |
|---|---|---|---|---|
| 2006/0063119 | A1 | 3/2006 | Molla | |
| 2013/0306056 | A1 | 11/2013 | Dora | |
| 2015/0107577 | A1* | 4/2015 | Jeong | F24C 3/08 126/39 E |

FOREIGN PATENT DOCUMENTS

| | | | |
|---|---|---|---|
| CN | 103791500 | A | 5/2014 |
| WO | 2012001715 | A1 | 1/2012 |

OTHER PUBLICATIONS

International Search Report and Written Opinion issued in International application No. PCT/EP2016/050961, dated Mar. 30, 2016, 8 pages.

* cited by examiner

GAS BURNER ASSEMBLY

The present invention relates to a gas burner assembly, in particular for a gas cooking hob. Further, the present invention relates to a gas cooking hob comprising at least one gas burner assembly.

A conventional gas burner assembly comprises a number of components, which have to be assembled during the production. For example, the gas burner assembly comprises a burner body and/or a burner support, a burner crown and/or a burner cap, a Venturi pipe and a gas injector. Further, the gas burner assembly requires a holding element for the gas injector and connecting elements and/or fastening elements for fixing the components.

If the gas burner assembly comprises a relative high number of components, then the production of the gas burner assembly is complex and causes high costs. If the gas burner assembly comprises a relative low number of components, then some single components have a complex geometric structure. In the latter case, the production of said complex components is difficult. Further, it is not easy to clean such complex components.

It is an object of the present invention to provide a gas burner assembly with a reduced number of components, wherein the components have relative simple geometric structures.

According to the present invention the gas burner assembly, in particular for a gas cooking hob, comprises a burner cap, a burner crown and a burner body, wherein

- the burner cap is arranged or arrangeable upon the burner crown,
- the burner crown is arranged or arrangeable upon the burner body,
- the gas burner assembly comprises at least one elongated horizontal Venturi pipe,
- an upper part of the Venturi pipe is formed in a lower portion of the burner crown,
- a lower part of the Venturi pipe is formed in the burner body,
- at least one chamber is formed in an upper portion of the burner crown,
- the burner crown includes at least one circumferential wall enclosing the at least one chamber and including a plurality of flame ports,
- the burner crown includes at least one passage opening connecting an outlet of the Venturi pipe to the at least one chamber,
- the Venturi pipe is formed by its upper part, its lower part and the passage opening, and
- a horizontal gap is formed between the burner crown and the burner body, wherein
- the horizontal gap is provided as an inlet for primary air and secondary air.

One aspect of the present invention is that the gas burner assembly comprises only three components, namely the burner cap, the burner crown and the burner body, wherein the Venturi pipe is composed by an upper part formed in the lower portion of the burner crown and by a lower part formed in the upper portion of the burner body. The Venturi pipe consists only of its upper part and passage opening both formed in the burner crown and its lower part formed in the burner body. The burner cap, the burner crown and the burner body have relative simple geometric structures resulting in an easy production and assembling of the components. Another aspect of the present invention is the horizontal gap enclosing the burner crown and/or the burner body and provided as the inlet for the primary air and the secondary air.

Preferably, the gas burner assembly is inserted in or insertable into a sheet of the gas cooking hob, wherein the horizontal gap is arranged above said sheet, so that the primary air and secondary air are caught from the space above the sheet of the gas cooking hob. This contributes to a simplified structure of the gas cooking hob.

Further, the burner crown may include at least one annular chamber. Said annular chamber delivers the mixture of gas and primary air provided by the Venturi pipe.

Alternatively or additionally, the burner crown includes a cylindrical chamber. Said cylindrical chamber delivers also the mixture of gas and primary air provided by the Venturi pipe.

According to a preferred embodiment of the present invention, the cylindrical chamber is arranged inside the annular chamber, wherein the cylindrical chamber and the annular chamber are spaced from each other and arranged at the same level.

In particular, the annular chamber is enclosed by an outer circumferential wall including a plurality of external flame ports, and the cylindrical chamber is enclosed by an inner circumferential wall including a plurality of internal flame ports.

For example, the cylindrical chamber and the annular chamber are interconnected via a conduit arranged at the same level as the cylindrical chamber and the annular chamber.

In this case, the burner cap covers the cylindrical chamber, the annular chamber and the conduit. The shape of the burner cap is adapted to the structure of the burner crown.

Further, the burner body may include a gas inlet arranged at an outer side of said burner body and a gas injector arranged inside said burner body, wherein the gas inlet and the gas injector are interconnected to each other. Preferably, the burner body with the gas inlet and the gas injector forms a single-piece part.

In particular, the gas injector is arranged at or in front of an inlet of the Venturi pipe. The cross-section of the Venturi pipe increases from its inlet to its outlet.

For example, the flame ports are formed as notches in the upper edge or upper edges of the at least one circumferential wall.

According to a special embodiment of the present invention, the external flame ports are sloped with respect to the horizontal plane, preferably at an angle about between 5° and 30°. The sloped external flame ports allow sloped flames, which increase the efficiency of the gas burner assembly.

Further, the burner cap may be formed as a single piece part. For example, the burner cap includes a C-shaped opening, so that the cylindrical chamber, the annular chamber and the conduit are covered by said burner cap and the flames from the internal flame port escape through the C-shaped opening.

In a similar way, the burner crown is formed as a single piece part.

Moreover, the burner body is formed as a single piece part.

At last, the present invention relates to a gas cooking hob comprising at least one gas burner assembly mentioned above.

Novel and inventive features of the present invention are set forth in the appended claims.

Figure 2:
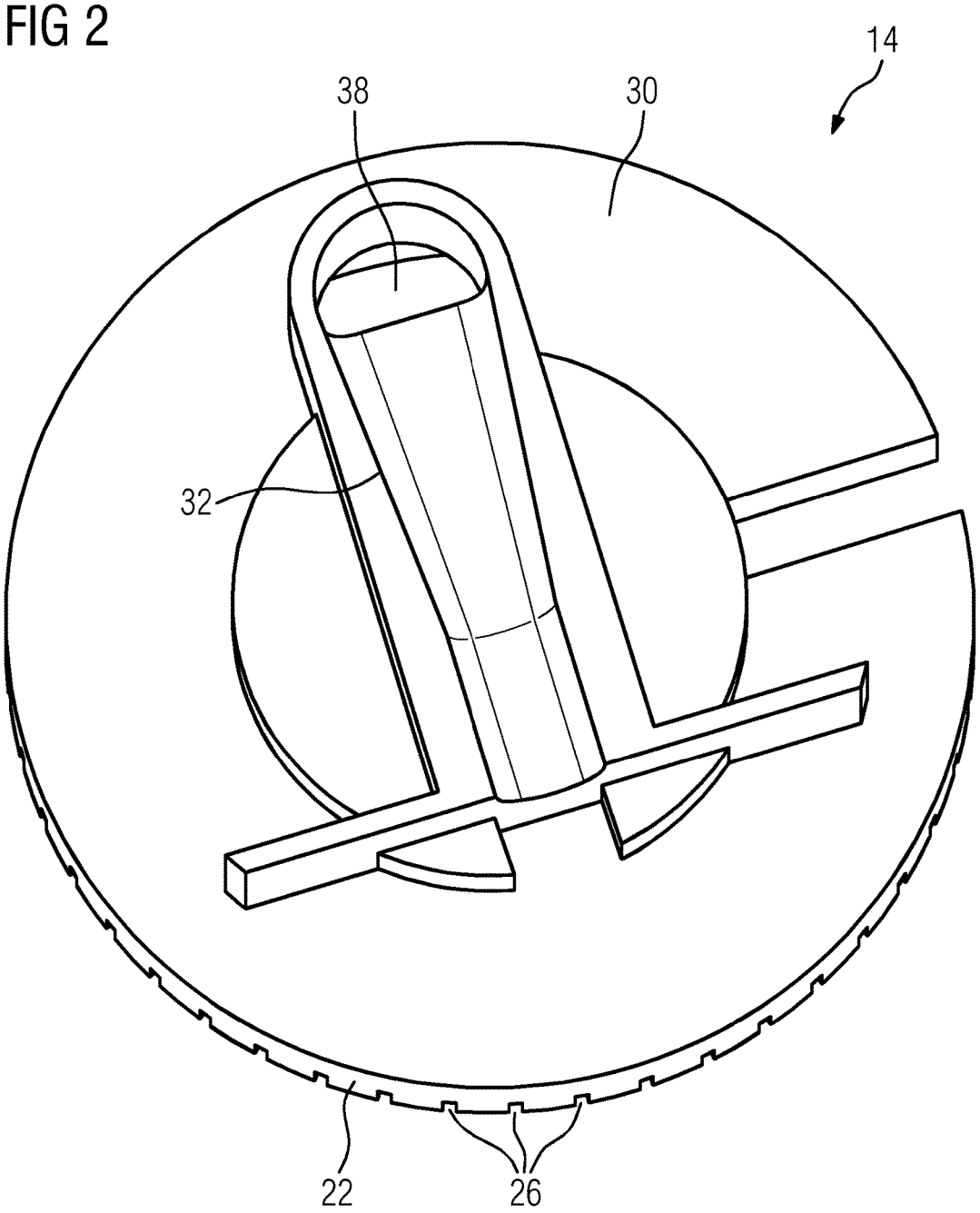
Figure 3:
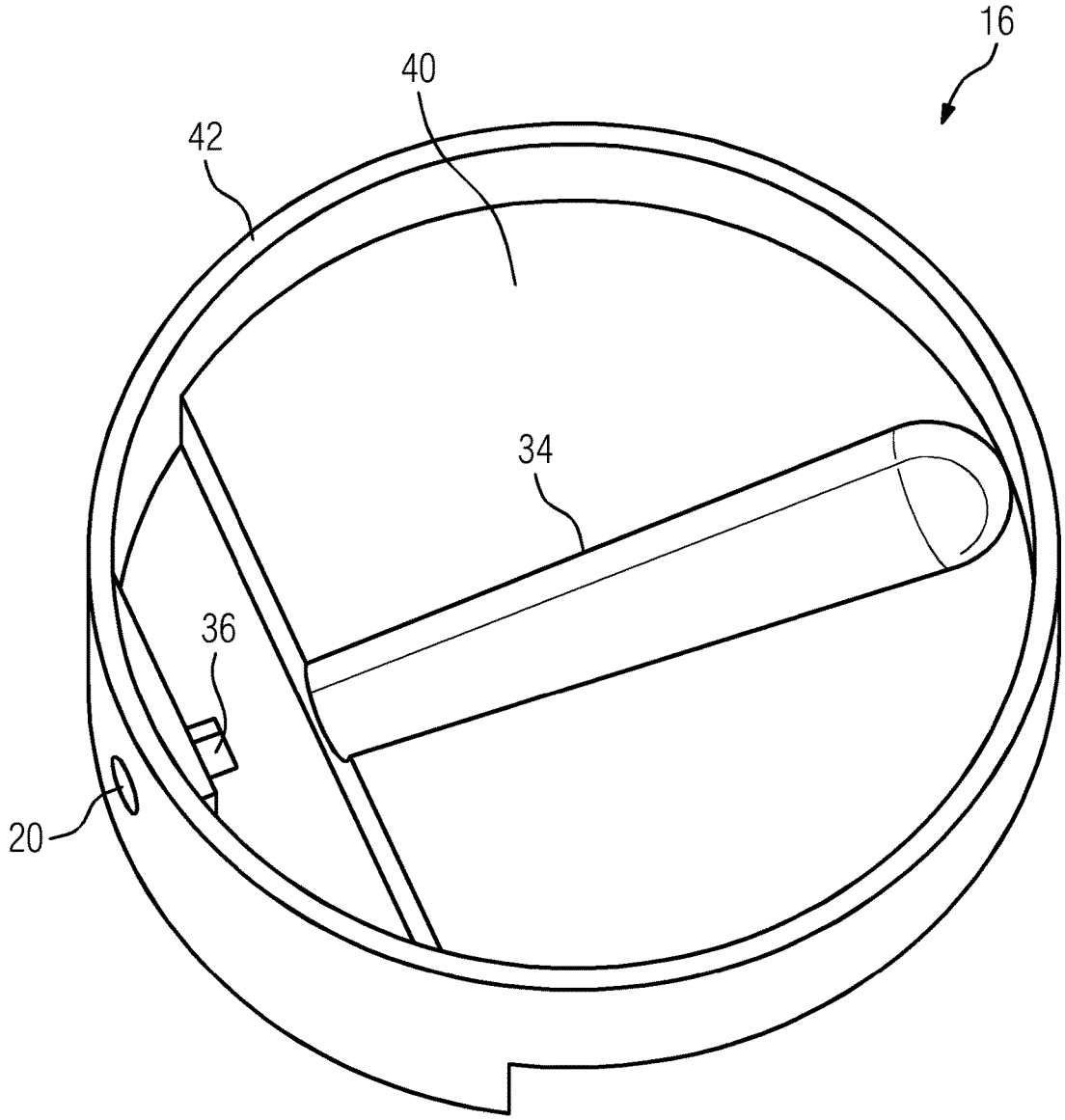
Figure 4:
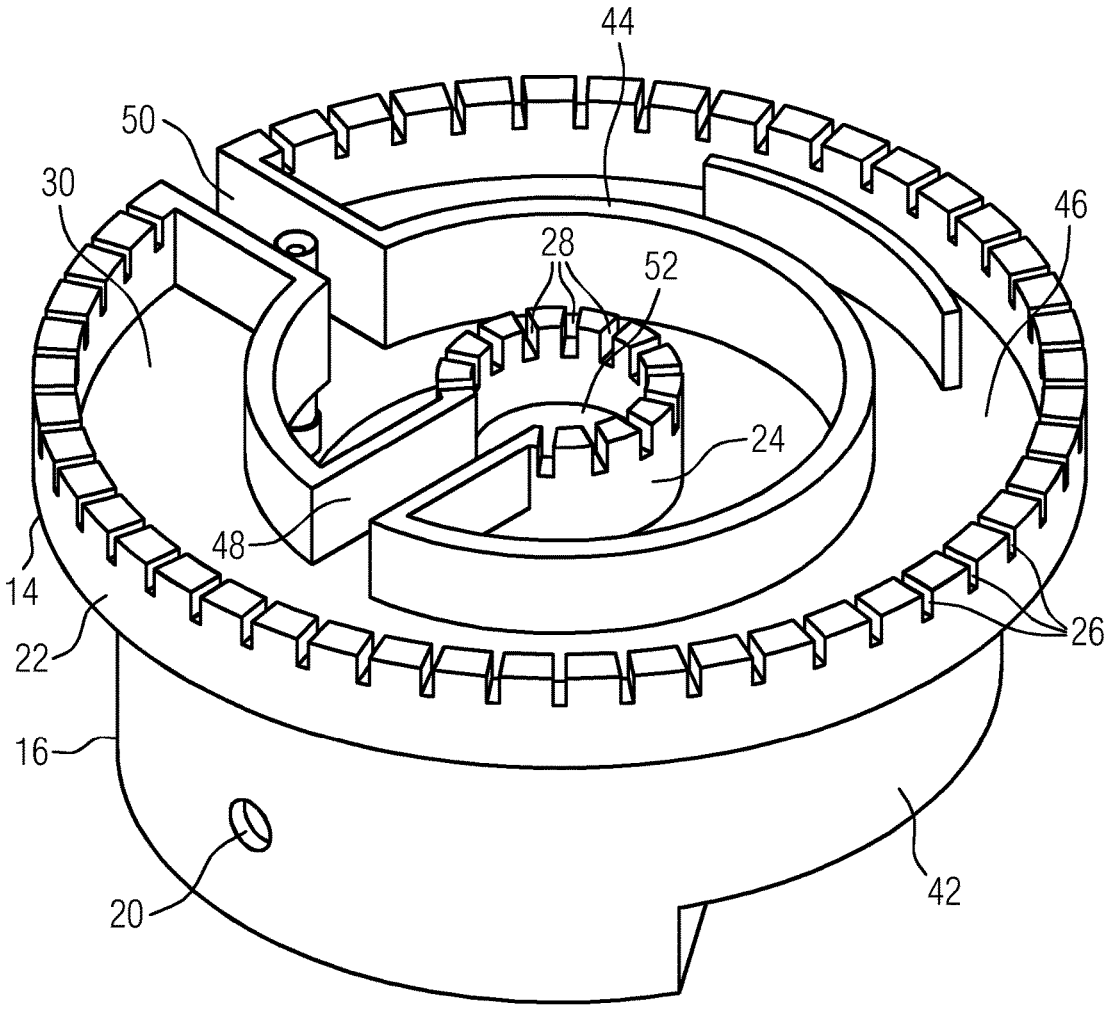
Figure 5:
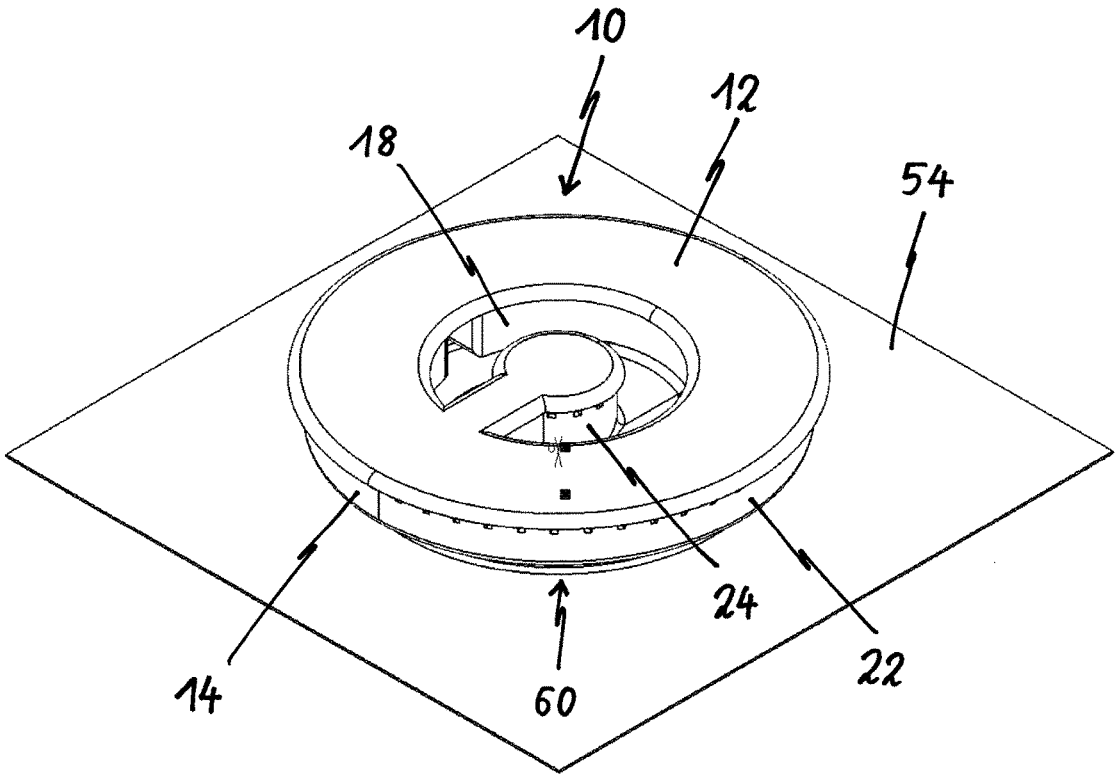
Figure 6:
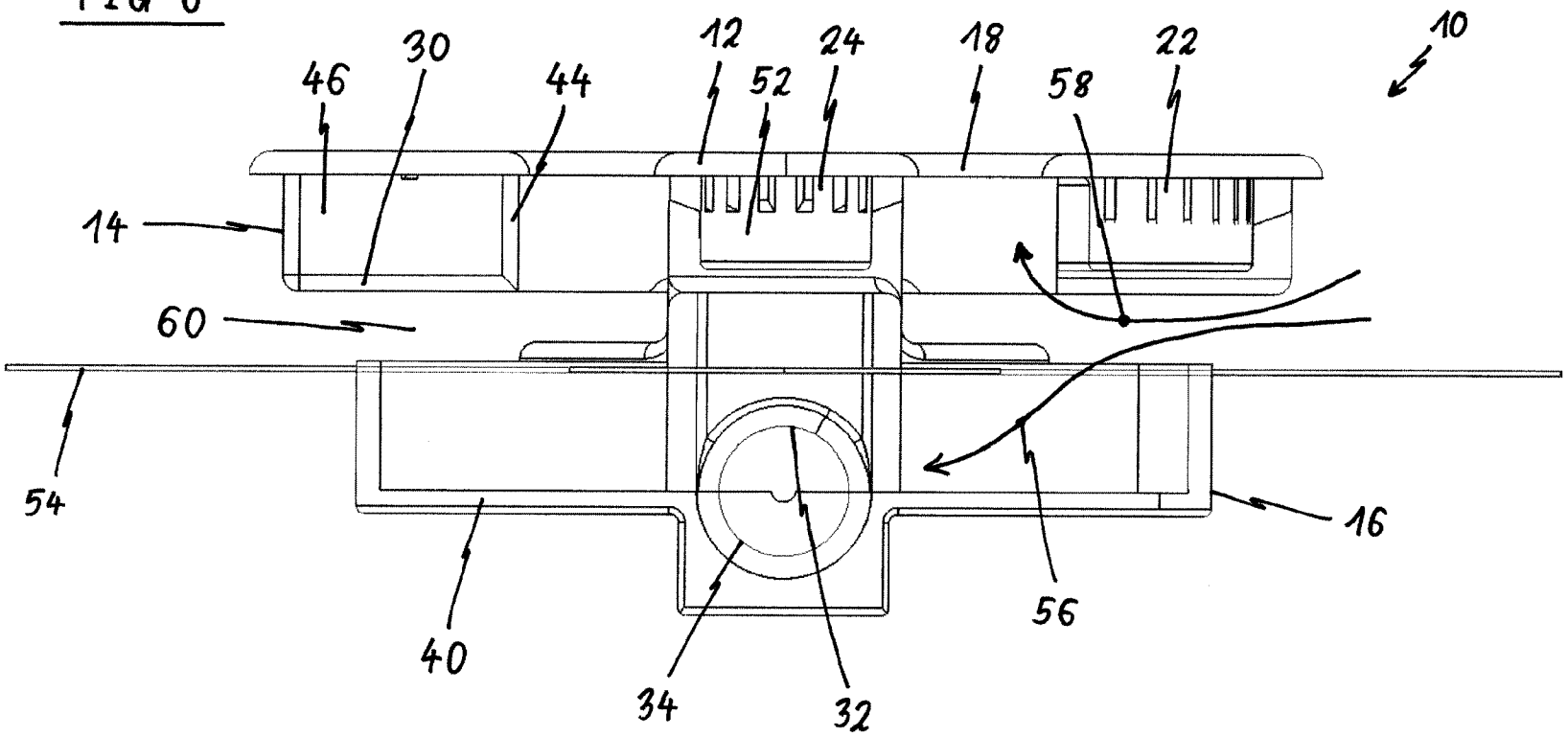
Figure 7:
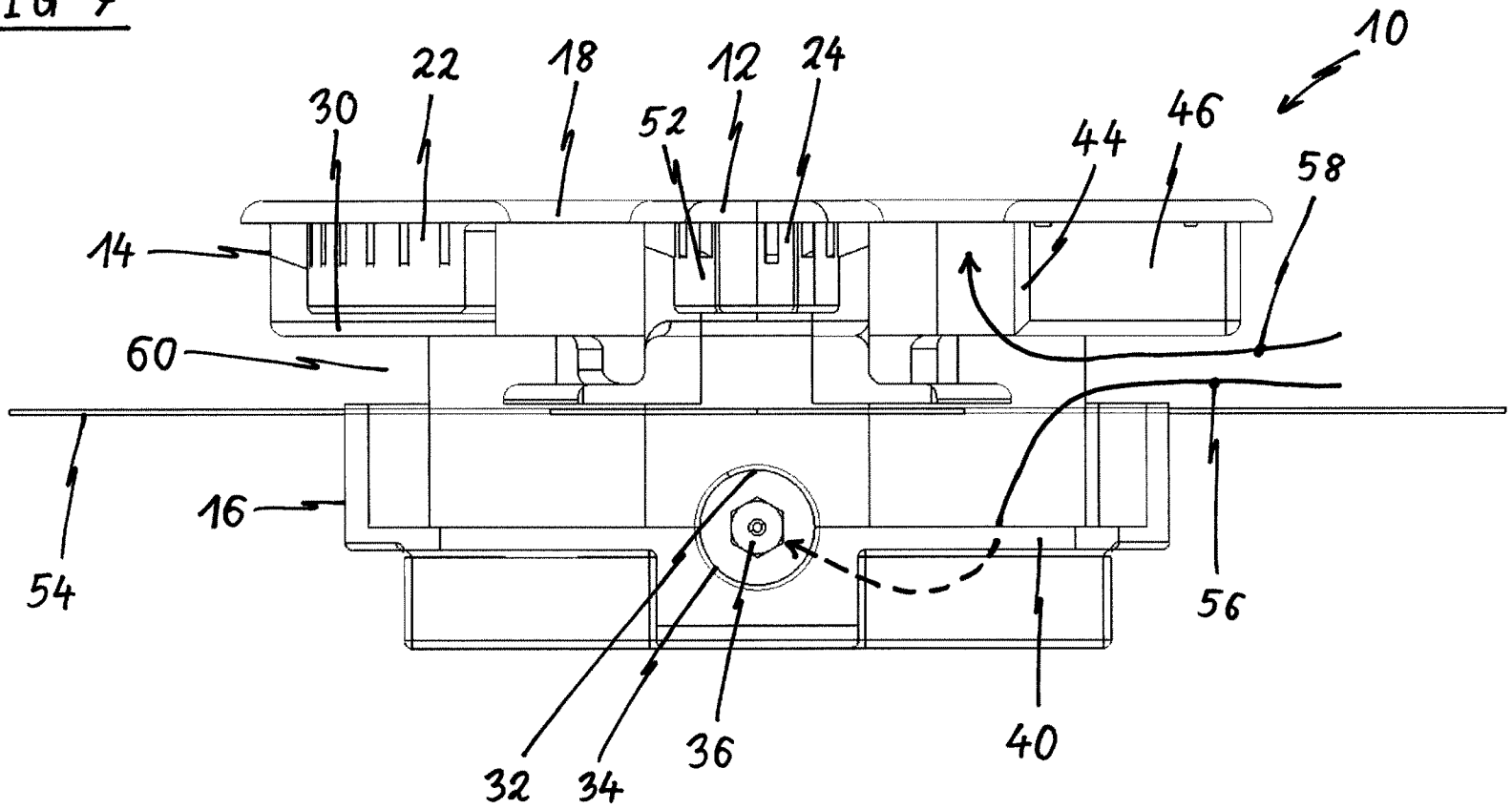
Figure 8:
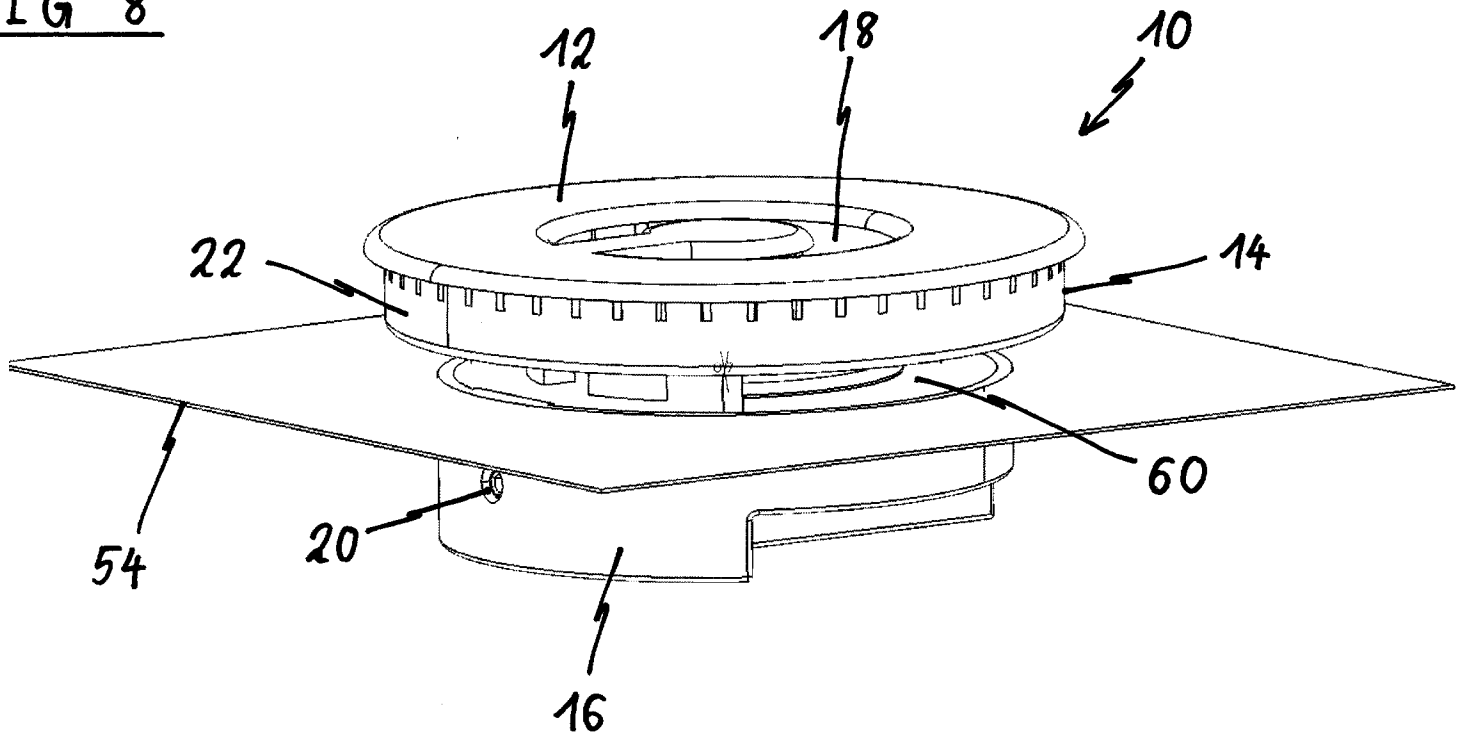

The present invention will be described in further detail with reference to the drawings, in which FIG. 1 illustrates a schematic perspective view of a gas burner assembly according to a preferred embodiment of the present invention, FIG. 2 illustrates a schematic perspective view at a lower side of a burner crown of the burner assembly according to the preferred embodiment of the present invention, FIG. 3 illustrates a schematic perspective view of a burner body of the gas burner assembly according to the preferred embodiment of the present invention, FIG. 4 illustrates a schematic perspective view of the gas burner assembly according to the preferred embodiment of the present invention, wherein a burner cap is removed, FIG. 5 illustrates a schematic perspective view of the gas burner assembly integrated within a sheet of a gas cooking hob according to the preferred embodiment of the present invention, FIG. 6 illustrates a schematic sectional side view of the gas burner assembly integrated within the sheet of the gas cooking hob according to the preferred embodiment of the present invention, FIG. 7 illustrates a schematic sectional side view of the gas burner assembly integrated within the sheet of the gas cooking hob according to the preferred embodiment of the present invention, and FIG. 8 illustrates a schematic perspective view of the gas burner assembly integrated within the sheet of the gas cooking hob according to the preferred embodiment of the present invention.

FIG. 1 illustrates a schematic perspective view of a gas burner assembly 10 according to a preferred embodiment of the present invention. The gas burner assembly 10 comprises a burner cap 12, a burner crown 14 and a burner body 16. The burner cap 12 is arranged above the burner crown 14 and covers said burner crown 14. In turn, the burner crown 14 is arranged above the burner body 16.

The burner cap 12 is formed as a flat circular disk. In this example, the burner cap 12 includes an opening 18 in its central portion. Said opening 18 has the shape of a section of an annular ring. In other words, the opening 18 is C-shaped. Thus, a small inner burner cap is formed in the central portion of the burner cap 12. The burner cap 12 is formed as a single-piece part. For example, the burner cap 12 is made of steel. Alternatively, the burner cap 12 may be made of cast iron by a sintering process.

The burner crown 14 includes an outer circumferential wall 22 and an inner circumferential wall 24. The outer circumferential wall 22 includes a plurality of external flame ports 26. In a similar way, the inner circumferential wall 24 includes a plurality of internal flame ports 28. The external flame ports 26 as well as the internal flame ports 28 are formed as notches in the upper edges of the outer circumferential wall 22 and inner circumferential wall 24, respectively.

The burner body 16 is arranged below the burner crown 14. The burner body 16 includes a gas inlet 20 formed in a circumferential side wall 42 of said burner body 16. Between the burner crown 14 and the burner body 16 a horizontal gap 60 is formed. Said horizontal gap 60 encloses the burner crown 14 and is provided as an inlet for primary air and secondary air.

FIG. 2 illustrates a schematic perspective view at a lower side of the burner crown 14 of the burner assembly 10 according to the preferred embodiment of the present invention.

The burner crown 14 includes a bottom plate 30. The outer circumferential wall 22 encloses the bottom plate 30 of the burner crown 14. The outer circumferential wall 22 extends upwards from the bottom plate 30 of the burner crown 14. The external flame ports 26 are formed in the upper edge of the outer circumferential wall 22 of the burner crown 14.

An upper part 32 of an elongated Venturi pipe is formed at the lower side of the bottom plate 30 of the burner crown 14. The Venturi pipe extends horizontally below the bottom plate 30 of the burner crown 14. The cross-section of the Venturi pipe increases continuously along its longitudinal axis. A passage opening 38 is formed in the bottom plate 30 of the burner crown 14. The passage opening 38 is arranged besides that end of the upper part 32 of the Venturi pipe, which comprises the bigger cross-section of said upper part 32 of the Venturi pipe. The passage opening 38 forms an outlet of the Venturi pipe.

FIG. 3 illustrates a schematic perspective view of the burner body 16 of the gas burner assembly 10 according to the preferred embodiment of the present invention.

The burner body 16 includes a base plate 40. The base plate 40 extends horizontally. A lower part 34 of the Venturi pipe is formed in an upper side of the base plate 40 of the burner body 16. The circumferential side wall 42 of the burner body 16 encloses the base plate 40. A gas injector 36 is arranged at an inner side of the circumferential side wall 42, wherein the gas inlet 20 is arranged at the opposite outer side of the circumferential side wall 42. The gas injector 36 is arranged besides that end of the lower part 34 of the Venturi pipe, which comprises the smaller cross-section of said upper part 32 of the Venturi pipe.

FIG. 4 illustrates a schematic top view of the gas burner assembly 10 according to the preferred embodiment of the present invention, wherein the burner cap 12 is removed. Thus, the burner crown 14 and the burner body 16 of the gas burner assembly 10 are shown.

The burner crown 14 is arranged above the burner body 16. The burner body 16 includes the gas inlet 20 formed in the circumferential side wall 42 of said burner body 16. The gas injector 36 is arranged inside the burner body 16 and behind the gas inlet 20.

The burner crown 14 includes the outer circumferential wall 22 with the external flame ports 26 and the inner circumferential wall 24 with the internal flame ports 28. The inner circumferential wall 24 with the internal flame ports 28 forms an inner crown. The inner circumferential wall 24 encloses a cylindrical chamber 52. The external flame ports 26 and the internal flame ports 28 are formed as notches in the upper edges of the outer circumferential wall 22 and inner circumferential wall 24, respectively. An intermediate circumferential wall 44 is arranged between the outer circumferential wall 22 and inner circumferential wall 24. In this example, the outer circumferential wall 22, the intermediate circumferential wall 44 and the inner circumferential wall 24 are arranged concentrically to each other.

An annular chamber 46 is formed between the outer circumferential wall 22 and the intermediate circumferential wall 44. Further, the annular chamber 46 is bordered by the burner cap 12 at its upper side and by the bottom plate 30 at its lower side. The annular chamber 46 is connected to the Venturi pipe via the passage opening 38.

Moreover, the burner crown 14 includes an inner conduit 48 connecting the annular chamber 46 to the cylindrical chamber 52 enclosed by the inner circumferential wall 24. An outer conduit 50 interconnects the cylindrical chamber 52 enclosed by the inner circumferential wall 24 and the intermediate circumferential wall 44 with the environment. The annular chamber 46, the cylindrical chamber 52 enclosed by the inner circumferential wall 24, the inner conduit 48 and the outer conduit 50 are covered by the burner cap 12.

The Venturi pipe is formed by its upper part 32 and its lower part 34, when the burner crown 14 is positioned on the burner bode 16. The passage opening 38 connects the Venturi pipe to the annular chamber 46.

Gas is feed to the gas inlet 20 and injected by the gas injector 38. The gas and primary air are mixed in the Venturi pipe or in a part of said Venturi pipe. The mixture of gas and primary air is conveyed into and delivered by the annular chamber 46. A part of said mixture of gas and primary air is delivered through the inner conduit 48 into the cylindrical chamber 52 enclosed by the inner circumferential wall 24. Flames are generated around the external flame ports 26 and internal flame ports 28. The flames are provided for heating a cooking vessel arranged upon the gas burner assembly 10.

Preferably, the external flame ports 26 are sloped with respect to the horizontal plane. In particular, the external flame ports 26 are sloped at an angle about between 5° and 30° with respect to the horizontal plane. The sloped external flame ports 26 allow sloped flames, which increase the efficiency of the gas burner assembly.

FIG. 5 illustrates a schematic perspective view of the gas burner assembly 10 integrated within a sheet 54 of a gas cooking hob according to the preferred embodiment of the present invention. The gas burner assembly 10 is inserted in a round cutout of the sheet 54. The burner body 14 is substantially arranged above the plane of the sheet 54, while the burner body is arranged below the plane of the sheet 54. The horizontal gap 60 enclosing the burner crown 14 is also arranged above the plane of the sheet 54.

FIG. 6 illustrates a schematic sectional side view of the gas burner assembly 10 integrated within the sheet 54 of the gas cooking hob according to the preferred embodiment of the present invention. FIG. 6 clarifies that the horizontal gap 60 enclosing the burner crown 14 is arranged above the plane of the sheet 54.

Streams of the primary air 56 and secondary air 58 are represented by arrows. The primary air 56 and the secondary air 58 enter the gas burner assembly 10 through the horizontal gap 60. Then, the primary air 56 enters via the burner body 16 the Venturf pipe 32 and 34, while the secondary air 58 enters the burner crown 14 between the annular chamber 46 and the cylindrical chamber 52 and passes the opening 18 of the burner cap 12. The primary air 56 and secondary air 58 are caught from the space above the sheet 54 of the gas cooking hob.

The burner crown 14 is substantially arranged above the plane of the sheet 54, while the burner body 16 is arranged below the plane of the sheet 54.

FIG. 7 illustrates a schematic sectional side view of the gas burner assembly 10 integrated within the sheet 54 of the gas cooking hob according to the preferred embodiment of the present invention.

The primary air 56 enters the gas burner assembly 10 through the horizontal gap 60 and then via the burner body 16 the Venturi pipe 32 and 34 close to the gas injector 36. The secondary air 58 enters the burner crown 14 between the annular chamber 46 and the cylindrical chamber 52 and passes the opening 18 of the burner cap 12.

FIG. 8 illustrates a schematic perspective view of the gas burner assembly 10 integrated within the sheet 54 of the cooking hob according to the preferred embodiment of the present invention. FIG. 8 clarifies also the arrangement of the horizontal gap 60 above the plane of the sheet 54. The primary air 56 and secondary air 58 are caught from the space above the sheet 54 of the gas cooking hob.

The gas burner assembly 10 according to the present invention has a low number of components. Preferably, the burner cap 12, the burner crown 14 and the burner body 16 are formed as single-piece parts in each case, so that the gas burner assembly 10 comprises only three components or substantially three components. In particular, the Venturi pipe as a separate component is avoided.

Further, the gas burner assembly 10 according to the present invention is producible by low costs. The burner body 16 is easy to clean. The horizontal Venturi pipe allows a high power of the gas burner assembly 10.

Although an illustrative embodiment of the present invention has been described herein with reference to the accompanying drawing, it is to be understood that the present invention is not limited to that precise embodiment, and that various other changes and modifications may be affected therein by one skilled in the art without departing from the scope or spirit of the invention. All such changes and modifications are intended to be included within the scope of the invention as defined by the appended claims.

LIST OF REFERENCE NUMERALS

10 gas burner assembly
12 burner cap
14 burner crown
16 burner body
18 opening
20 gas inlet
22 outer circumferential wall
24 inner circumferential wall
26 external flame port
28 internal flame port
30 bottom plate of the burner crown
32 upper part of the Venturi pipe
34 lower part of the Venturi pipe
36 gas injector
38 passage opening
40 base plate
42 circumferential side wall
44 intermediate circumferential wall
46 annular chamber
48 inner conduit
50 outer conduit
52 cylindrical chamber
54 sheet of gas cooking hob
56 primary air stream
58 secondary air stream
60 horizontal gap

The invention claimed is:

1. A gas burner assembly for a gas cooking hob, comprising a burner cap, a burner crown and a burner body, wherein the burner cap is arranged or arrangeable upon the burner crown, the burner crown is arranged or arrangeable upon the burner body, the gas burner assembly comprises at least one elongated horizontal Venturi pipe, an upper part of the Venturi pipe is formed in a lower portion of the burner crown, a lower part of the Venturi pipe is formed in the burner body, at least one chamber is formed in an upper portion of the burner crown, the burner crown includes at least one circumferential wall enclosing the at least one chamber and including a plurality of flame ports, the burner crown includes at least one passage opening connecting an outlet of the Venturi pipe to the at least one chamber, the Venturi pipe is formed by its upper part, its lower part and the passage opening, and a horizontal gap is formed between the burner crown and the burner body, wherein the horizontal gap is provided as an inlet for primary air and secondary air.

2. The gas burner assembly according to claim 1, wherein the gas burner assembly is inserted in or insertable into a sheet of the gas cooking hob, wherein the horizontal gap is arranged above said sheet, so that the primary air and secondary air are caught from the space above the sheet of the gas cooking hob.

3. The gas burner assembly according to claim 1, wherein the burner crown includes at least one annular chamber and/or a cylindrical chamber.

4. The gas burner assembly according to claim 3, wherein the cylindrical chamber is arranged inside the annular chamber, wherein the cylindrical chamber and the annular chamber are spaced from each other and arranged at the same level.

5. The gas burner assembly according to claim 4, wherein the annular chamber is enclosed by an outer circumferential wall including a plurality of external flame ports, and the cylindrical chamber is enclosed by an inner circumferential wall including a plurality of internal flame ports.

6. The gas burner assembly according to claim 4, wherein the cylindrical chamber and the annular chamber are interconnected via a conduit arranged at the same level as the cylindrical chamber and the annular chamber.

7. The gas burner assembly according to claim 6, wherein the burner cap covers the cylindrical chamber, the annular chamber and conduit.

8. The gas burner assembly according to claim 1, wherein the burner body includes a gas inlet arranged at an outer side of said burner body and a gas injector arranged inside said burner body, wherein the gas inlet and the gas injector are interconnected to each other.

9. The gas burner assembly according to claim 1, wherein the gas injector is arranged at or in front of an inlet of the Venturi pipe.

10. The gas burner assembly according to claim 1, wherein the flame ports are formed as notches in the upper edge or upper edges of the at least one circumferential wall.

11. The gas burner assembly according to claim 5, wherein the external flame ports are sloped with respect to the horizontal plane at an angle about between 5° and 30°.

12. The gas burner assembly according to claim 1, wherein the burner cap is formed as a single piece part.

13. The gas burner assembly according to claim 1, wherein the burner crown is formed as a single piece part.

14. The gas burner assembly according to claim 1, wherein the burner body is formed as a single piece part.

15. A gas cooking hob comprising at least one gas burner assembly, wherein the gas cooking hob comprises at least one gas burner assembly according to claim 1.

* * * * *